US008657150B2

(12) United States Patent
Kloss et al.

(10) Patent No.: US 8,657,150 B2
(45) Date of Patent: Feb. 25, 2014

(54) CLOSURE SEAL FOR A CONTAINER FOR STORING DANGEROUS LIQUID MATERIAL

(75) Inventors: Uwe Kloss, Seesen (DE); Birger Keilberg, Garbsen (DE); Manfred Hubert, Woltershausen (DE)

(73) Assignee: Ardagh MP Group Netherlands B.V., Deventer (NL)

( * ) Notice: Subject to any disclaimer, the term of this patent is extended or adjusted under 35 U.S.C. 154(b) by 915 days.

(21) Appl. No.: 11/575,594

(22) PCT Filed: Sep. 23, 2005

(86) PCT No.: PCT/DE2005/001691

§ 371 (c)(1),
(2), (4) Date: Mar. 20, 2007

(87) PCT Pub. No.: WO2006/032264

PCT Pub. Date: Mar. 30, 2006

(65) Prior Publication Data

US 2007/0289984 A1 Dec. 20, 2007

(30) Foreign Application Priority Data

Sep. 24, 2004 (DE) ..... 10 2004 046 677
Oct. 8, 2004 (DE) ..... 10 2004 049 225

(51) Int. Cl.
*B65D 43/02* (2006.01)
*B65D 43/04* (2006.01)

(52) U.S. Cl.
USPC ..... 220/803; 220/789; 220/790; 220/794; 220/802; 220/804; 220/795; 220/806; 220/378

(58) Field of Classification Search
USPC ..... 220/795, 780, 782, 783, 789, 790, 792, 220/794
See application file for complete search history.

(56) References Cited

U.S. PATENT DOCUMENTS 505,853 A * 10/1893 Schmitz ..... 220/789
2,001,748 A * 5/1935 Saalbach ..... 220/319
2,063,557 A * 12/1936 Punte ..... 220/320

(Continued)

FOREIGN PATENT DOCUMENTS

BE 864362 A * 8/1978
BE 898168 A * 3/1984

(Continued)

OTHER PUBLICATIONS

Russian Decision to Grant Issued for 2007104108/12 (004422) dated Sep. 23, 2005.

(Continued)

*Primary Examiner* — J. Gregory Pickett
*Assistant Examiner* — Ned A Walker
(74) *Attorney, Agent, or Firm* — Hunton & Williams LLP

(57) ABSTRACT

Exemplary embodiments include a seal between an open body end of a container body and an edge of a lid. The lid is pressable into the open end of the body in a sealing manner. The components may be made from a light gauge sheet metal. The lid can be removable affixed to the body. The seal is configured to securely attach to the body to provide a safe seal of the container to be capable of withstanding impacts, such as from a shock or fall. Accordingly, the embodiments are applicable to containers which contain hazardous materials.

9 Claims, 3 Drawing Sheets

(56) References Cited

U.S. PATENT DOCUMENTS

| | | | | | |
|---|---|---|---|---|---|
| 2,148,468 | A | * | 2/1939 | Hothersall | 220/378 |
| 2,579,974 | A | * | 12/1951 | Scott et al. | 229/5.5 |
| 3,771,688 | A | * | 11/1973 | Frankenberg et al. | 220/271 |
| 3,902,630 | A | * | 9/1975 | Knize | 220/319 |
| 3,915,336 | A | * | 10/1975 | Spreng | 220/284 |
| 3,977,563 | A | * | 8/1976 | Holt | 206/508 |
| 4,078,696 | A | * | 3/1978 | Crisci | 220/795 |
| 4,166,548 | A | * | 9/1979 | Crisci | 220/795 |
| 4,337,874 | A | * | 7/1982 | Hoenig et al. | 220/783 |
| 4,676,392 | A | * | 6/1987 | Giggard et al. | 220/284 |
| 4,742,932 | A | * | 5/1988 | Pedragosa | 220/619 |
| 4,846,366 | A | * | 7/1989 | Satz | 220/787 |
| 4,881,658 | A | * | 11/1989 | VanCucha | 220/792 |
| 4,887,736 | A | * | 12/1989 | VanCucha | 220/792 |
| 4,946,064 | A | * | 8/1990 | VanCucha | 220/795 |
| 5,065,888 | A | | 11/1991 | Gallagher | |
| 5,143,219 | A | * | 9/1992 | Yates, Jr. | 206/508 |
| 5,295,603 | A | | 3/1994 | Schormair | |
| 5,328,047 | A | * | 7/1994 | Smith | 220/790 |
| 5,984,137 | A | * | 11/1999 | Grosjean | 220/789 |
| 6,021,917 | A | * | 2/2000 | Lovell et al. | 220/782 |
| 6,834,772 | B1 | * | 12/2004 | Thorsø | 220/795 |
| 2002/0148846 | A1 | * | 10/2002 | Luburic | 220/792 |
| 2002/0148847 | A1 | * | 10/2002 | Luburic | 220/795 |
| 2002/0175172 | A1 | * | 11/2002 | Diesterbeck | 220/782 |
| 2002/0175173 | A1 | * | 11/2002 | Diesterbeck | 220/782 |
| 2002/0175174 | A1 | * | 11/2002 | Diesterbeck | 220/782 |
| 2003/0015542 | A1 | * | 1/2003 | Nulty et al. | 220/780 |
| 2005/0224499 | A1 | | 10/2005 | Jorgensen et al. | |

FOREIGN PATENT DOCUMENTS

| | | | | |
|---|---|---|---|---|
| DE | 33 39 777 | | | 5/1984 |
| DE | 3837786 | A | * | 5/1989 |
| EP | 0 535 383 | | | 4/1993 |
| EP | 737625 | A1 | * | 10/1996 |
| EP | 791538 | A1 | * | 8/1997 |
| EP | 1495980 | A1 | * | 1/2005 |
| FR | 2563812 | A | * | 11/1985 |
| FR | 2580258 | | | 4/1986 |
| FR | 2580258 | | | 10/1986 |
| FR | 2 658 483 | A1 | | 8/1991 |
| FR | 2669896 | A1 | | 6/1992 |
| FR | 2908391 | A1 | * | 5/2008 |
| JP | S59-51044 | A | | 3/1964 |
| JP | H06-42701 | U | | 6/1994 |
| JP | 2005-515129 | A | | 5/2005 |
| RU | 2065390 | | | 8/1996 |
| SU | 2065390 | | | 11/1991 |
| WO | WO 92/04248 | | | 3/1992 |
| WO | WO 9204248 | A | * | 3/1992 |
| WO | WO 98/35882 | | | 8/1998 |
| WO | WO 9835882 | A1 | * | 8/1998 |
| WO | 03/062081 | A1 | | 7/2003 |

OTHER PUBLICATIONS

Russian Decision to Grant Issued dated Sep. 16, 2010.

* cited by examiner

CLOSURE SEAL FOR A CONTAINER FOR STORING DANGEROUS LIQUID MATERIAL

CROSS REFERENCE TO RELATED APPLICATIONS

This application claims the benefit of PCT Application DE2005/001691, filed on Sep. 23, 2005, German Patent Application 10 2004 046 677.7, filed Sep. 24, 2004, and German Patent Application 10 2004 049 225.5, filed Oct. 8, 2004, the content of which are incorporated herein by reference.

FIELD OF THE DISCLOSURE

The disclosure relates to a seal between the open body end of a container and an edge of a lid that may be pressed into the open body end. The lid may be removable. Both components may be made from (relatively) light gauge sheet metal. It is of primary concern to provide for a particularly safe seal, in particular for liquid hazardous materials, capable to also withstand mechanical impact such as from shock or fall.

BACKGROUND OF THE DISCLOSURE

A seal for a sheet metal container is shown in WO-A 1992/04248 (Baltics). This seal assembly provides for an intermediate ring that receives a seal ring and that contributes to the mechanical safeguarding of the appropriate engagement of the lid in the closed position. For safety an adhesive is applied to the respective interacting sealing surfaces which interconnects the compound.

SUMMARY OF THE DISCLOSURE

According to an embodiment of the present disclosure a seal may be provided which may possess the requisite high standards pertaining to such seal applications, and may be simpler and more economical to produce.

The insertable lid herein may be essentially similar to existing shapes of lids, allowing for the use of prevailing manufacturing methods and tools. Technical modifications can thus be held to a minimum, constituting an attendant objective of the disclosure rather than impeding the same.

According to an embodiment of the present disclosure, a high degree of leak tightness may be achieved through the (direct) interaction between open body end (end of body) and lid edge (edge of the lid), rendering the use of an additional intermediate ring redundant. In the area of a sharp bend, the open body end may abut against (directly, or indirectly through a residual compound welt) the lid sheet metal (the defining edge) within its at least partially rolled edge (rolled edge) and thus may provide for a seal through direct contact, preferably with an expandable surface, under a reciprocal radial preload.

This area may be, at the same time, covered in the radially peripheral area by the sealing material (compound) provided within the rolled edge of the lid, in particular provided as a swelling compound.

In the course of a closing process, the body end with its bending radius comes into contact with the sealing material on the outside of the defining edge of the lid.

Subsequently several exemplary embodiments illustrate and supplement the disclosure.

DETAILED DESCRIPTION OF PREFERRED EMBODIMENTS

Figure 1:
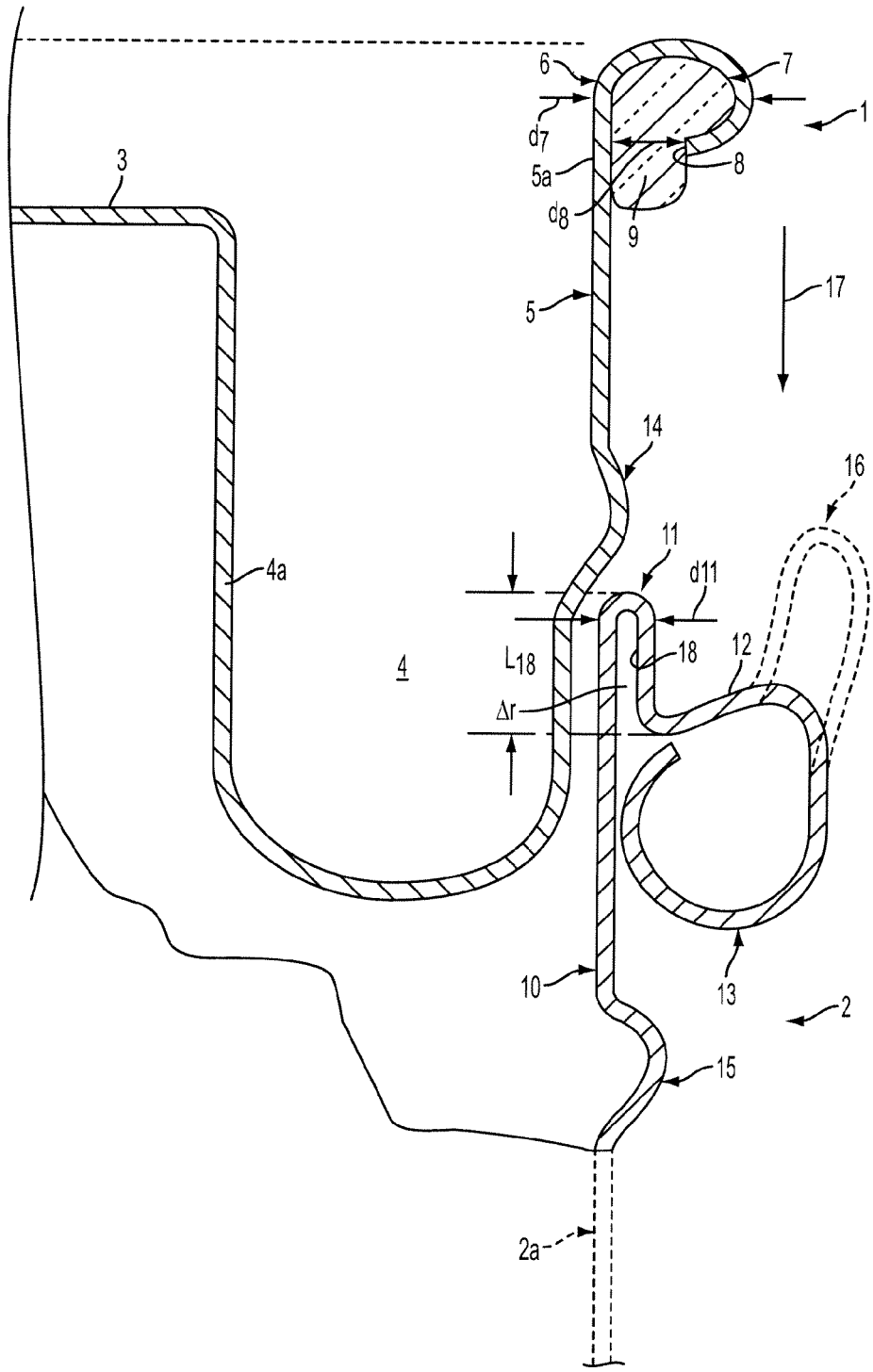
FIG. 1 shows the components of the lid and the open body end of a sealed, or sealable container, or a container that can be opened, which may be relevant to the seal, each in an axial sectional view and with the seal open.

The lid 1 as a component of the seal has an edge (edge section 1) with the lid surface 3 connected through a relatively deep, channel-like bead 4, which can also serve to dampen for example mechanical impacts. Its outer defining edge 5 extends in axial direction past the lid surface 3 and transitions into an outward bent rolled edge 7, whose sheet edge 8 ends at a (distinct) radial distance from the upper section 5a of the defining edge 5. The rolled edge has a sufficiently sized bending radius allowing for a sealing material 9 of appropriate volume to be received within it, which extends downward beyond the lower opening slot d8 of the rolled edge 7, over a certain distance alongside the defining edge 5.

The barrel 2*a*,10 of the container 2 (the body) may be bent outward by 180" with a small bending radius 11 in order to provide for the opening of the body or container. The sheet metal 18 extends from the bending radius in the radial distance Δr predetermined by the dimension of the bending radius, in parallel with the barrel 10 of the body and axially downward with a longitudinal dimension L18, which distinctly exceeds the diameter d7 of the rolled edge 7 of the lid 1.

Subsequently, the sheet metal is bent outward in a radially and axially rising manner in order to form a support shoulder 12. At the peripheral edge of the support shoulder, the sheet metal is axially bent downward and ends in a roll-in 13 provided with a large diameter as compared to the rolled edge 7 of the lid or to the diameter dimension d11 of the small or sharp bend 11, the diameter being chosen such that the roll-in 13 is adjacent to the body wall 10 with its radially interior section or even abuts against it.

In a modification the body sheet metal can be shaped, at least in a given section, between the support shoulder 12 and the roll-in 13, into an outwardly protruding opening aid 16, as depicted in dashed lines in FIG. 1, as a protruding lug 16.

Figure 2:
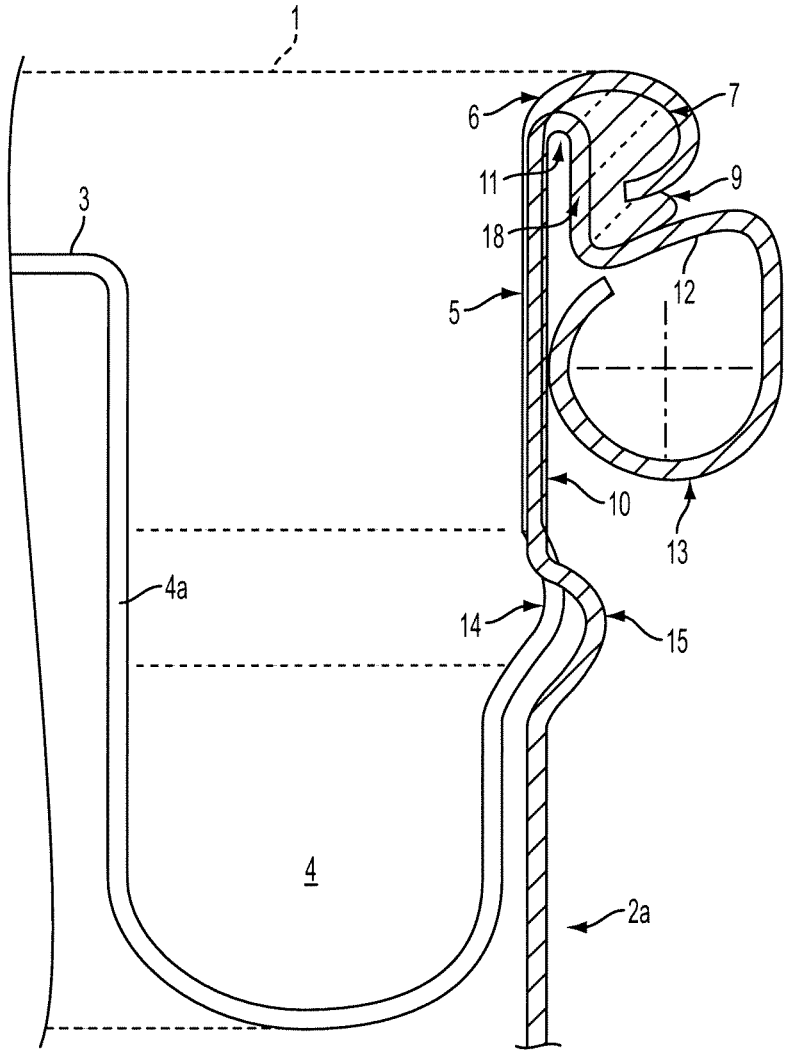
FIG. 2 shows the components as in FIG. 1, but in the closed position.

In order to mechanically secure the engagement of the lid with the body end after closing, the body wall 10 and the outer defining edge 5 of the lid 1 each possess a corrugation 15 or 14, or a similar engaging element. FIG. 1 shows the lid in a position facing the open body end immediately prior to the initiation of the insertion process according to the arrow 17. FIG. 2 shows the final closed position.

The open body end 10 with the bend 11 extends as far as possible into the interior of the rolled edge 7, approximately to the transition 6 between the outer defining edge 5 and the rolled edge 7 of the lid. The body barrel 10 enters into (direct or indirect) contact with the outer defining edge 5. This contact extends along the surfaces of the wall segments 5 and 10 and may occur under a radial preload as suggested schematically in FIG. 2 by the overlap of the sheet metal sectional surfaces. A residual layer of compound 9, which was displaced here, may be present on the outside. This also represents a contact of the defining edge 5 by the open body end.

By means of this contact, which is being established under preload, a reliable seal may already be accomplished by mechanical means between the two participating elements of the seal.

FIG. 2 further illustrates, that the radial distance of the sheet edge 8 from the defining edge 5 may be selected so that on the one hand the container neck with its bending radius 11 safely slide itself into the rolled edge 7 and that on the other hand the sealing material 9 within the rolled edge 7 and also outside in the are of the shoulder support may maintain a reliably continuous cross section. The sealing material herein may be maintained under pressure within the rolled edge 7, as well as between same and the support shoulder 12, thus substantially augmenting the sealing effect and making the application of an adhesive in the area of the sealing surfaces redundant.

The deep and wide channeled bead 4, the large rolled edge 7, the radial distance between the wall sections 10 and 18, the beveled support shoulder 12, and the large volume roll-in 13 at least adjacent to the body 10, in combination form a very effective cushioning and damping system, which may be capable of safely absorbing any impacts from pressure or shock, that may affect the area of the seal from the outside, without compromising seal effectiveness under these impacts.

The description and illustration of the seal clarifies, that the body end 10 with all elements of the seal—11, 18, 12, 13, and, if applicable, 16—can be formed from a single sheet metal blank. An additional intermediary ring is not required.

The lid can be essentially manufactured with known methods and means. The entire seal can thus be produced in a simple and economical manner, providing for excellent stability and tightness, thus making it suitable for hazardous materials containers.

Figure 3:
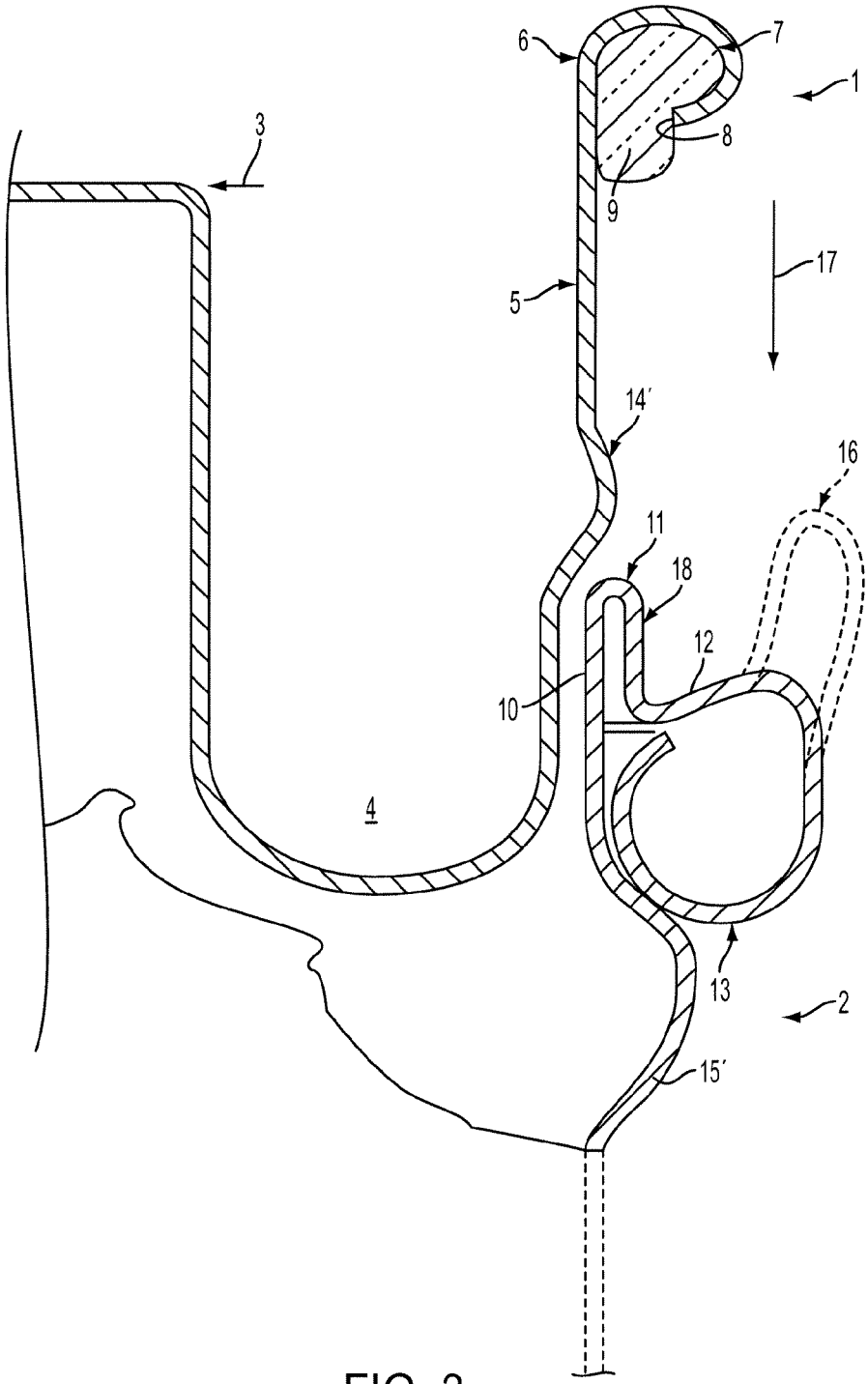
FIG. 3 shows a further embodiment.

In a further embodiment according to FIG. 3, reference can be made for the purpose of illustration to the unsealed state (depicting the state at the beginning of the closing process)—according to FIG. 1. Similarly, the closed state according to FIG. 2 can be transposed to FIG. 3 and is not depicted separately here.

The modification compared to the earlier described embodiments pertains to the body corrugation 15, which may be formed as a corrugation 15' in a more pronounced radial and outward manner, thus providing for a supporting effect to the annular roll-in 13. According to FIG. 1, the annular roll-in may be provided adjacent to the container body 10 (specifically the upper body section of container body 2), in particular in a contacting manner. If the corrugation 15 is moved to a higher axial position, a radial support of the roll-in 13 will result over a certain distance, thus additionally stabilizing the position of the support shoulder 12, possibly also the opening aid 16 as depicted (dashed lines) in a further exemplary embodiment.

The body or container corrugation 15' may also be provided axially more extended, but similarly also less extended, for example such as illustrated in FIG. 1.

The section 14' of the lid which is engaging into the corrugation 15' may be formed such that positive locking and/or a friction engagement may be achieved when assuming its closed position within the corrugation 15'. An at least partial degree of lateral support may also be provided, whereby the axial upward pressure of the corrugation 14' within the lid can be utilized for the further support of the corrugation 15' in the container, wherein both corrugations can jointly support the annular roll-in 13 in the radially inward, and the axially downward direction.

An interconnection of support corrugations and roll-ins, which join from all adjacent elements of the seal area, may be created.

We claim:

1. A removable seal, comprising:

an open position and a closed position;

an upper body end of a container body and an edge portion of a lid, wherein in the open position the lid is insertable into the upper body end to form the closed position, wherein at the upper body end a terminal portion is bent outward by 180° providing a sharp body curvature, and an outer lid portion being radially spaced from a lid surface by a u-shaped channel and extending axially upward with a circumferential extending outer flank of the u-shaped channel and being bent outwards with a lid curvature being less than the sharp body curvature, the outer lid portion thereby forming a curved lid rim portion carrying an annular sealing material therein, the annular sealing material extending downwards, and wherein the lid rim portion has a free edge directed towards the outer flank, holding the annular sealing material and terminating at a radial distance from the outer flank, said radial distance allowing the sharp body curvature to enter into an interior of the curved lid rim portion in contact with the outer flank of the lid and the annular sealing material in the closed position, the terminal portion is being further bent radially to form a support shoulder comprising a shoulder surface rising radially outward and slanted upward suitable for supporting the annular sealing material in the closed position and further the terminal portion is bent axially downward from a peripheral radial end of the support shoulder, and then the terminal portion is rolled radially inward to create a curl outwardly adjacent to the upper body end.

2. The removable seal according to claim 1, wherein the upper body end and one or more body specific elements of the seal are integrally formed from one sheet metal blank.

3. The removable seal according to claim 1, wherein the lid and the upper body end are held in the closed position by corrugations in the outer flank and in the terminal portion in one of a positively locking manner or a frictionally locking manner under a radial preload.

4. The removable seal according to claim 1, wherein in the closed position the upper body end with the sharp body curvature contacts the annular sealing material on an exterior of the outer flank of the lid.

5. The removable seal according to claim 1, wherein a bending radius of the terminal portion that is rolled radially inward is selected such that the terminal portion that is rolled radially inward abuts against a circumferential radial protrusion of a body wall.

6. The removable seal according to claim 1, wherein a diameter of the upper body end in an area of the sharp body curvature and a lid edge diameter in the area of a transition between the outer flank and the curved portion are matched, so that in the closed position the upper body end with the sharp body curvature will abut inwardly at a transition between the outer flank and the curved portion, while being under a radially inward tension.

7. The removable seal according to claim 1 or 6, wherein the annular sealing material is a swelling compound.

8. The removable seal according to claim 1, wherein the terminal portion between the support shoulder and the curl is formed into at least one of a radially or axially protruding lug.

9. The removable seal according to claim 8, wherein the at least one radially or axially protruding lug is shaped to provide an opening aid for the lid.

* * * * *

UNITED STATES PATENT AND TRADEMARK OFFICE

CERTIFICATE OF CORRECTION

PATENT NO. : 8,657,150 B2
APPLICATION NO. : 11/575594
DATED : February 25, 2014
INVENTOR(S) : Kloss et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 873 days.

Signed and Sealed this
Twenty-ninth Day of September, 2015

Michelle K. Lee

Michelle K. Lee
*Director of the United States Patent and Trademark Office*